US005573138A

United States Patent [19]

Lin

[11] Patent Number: 5,573,138

[45] Date of Patent: Nov. 12, 1996

[54] APPARATUS FOR SQUEEZING FLUID OUT OF A COLLAPSIBLE TUBE

[76] Inventor: Hsia-Sen Lin, No. 27, Ing Min 1 Lane, Tao Ing Road, Bar Der City, TaoYuan, Taiwan

[21] Appl. No.: 600,188

[22] Filed: Feb. 12, 1996

[51] Int. Cl.[6] ..... B65D 35/28; B65D 35/54

[52] U.S. Cl. ..... 222/96; 222/102; 222/505

[58] Field of Search ..... 222/95, 96, 102, 222/505

[56] References Cited

U.S. PATENT DOCUMENTS

| | | | |
|---|---|---|---|
| 1,207,534 | 12/1916 | Gammeter | 222/102 |
| 2,837,243 | 6/1958 | La Zebnik | 222/96 X |
| 3,221,940 | 12/1965 | Watson, Jr. | 222/96 |
| 3,257,037 | 6/1966 | Watson, Jr. | 222/96 |
| 3,289,893 | 12/1966 | Vance et al. | 222/102 |
| 3,332,579 | 7/1967 | Peters | 222/96 |
| 5,397,030 | 3/1995 | Williams | 222/102 X |

*Primary Examiner*—Kevin P. Shaver
*Attorney, Agent, or Firm*—Bacon & Thomas

[57] ABSTRACT

An apparatus for squeezing fluid out of the neck of a collapsible tube installed therein, including a base frame, a L-shaped supporting frame moved in the base frame in the longitudinal direction, an actuating plate pivotably connected to the back side of the vertical portion of the L-shaped supporting frame and having a push rod inserted through a hole on the L-shaped supporting frame, a cover board pivoted to the front side of the vertical portion of the L-shaped supporting frame, and a push plate suspending below the board and coupled to the actuating plate, wherein the push rod of the actuating plate is forced to push the cover board away from the neck of the collapsible tube and the L-shaped supporting frame is simultaneously moved toward the rollers to squeeze the collapsible tube when the push plate is depressed, thereby causing fluid to be forced out of the collapsible tube.

10 Claims, 2 Drawing Sheets

APPARATUS FOR SQUEEZING FLUID OUT OF A COLLAPSIBLE TUBE

BACKGROUND OF THE INVENTION

The present invention relates to an apparatus for squeezing fluid out of a collapsible tube which closes the outlet of the collapsible tube when does no work and, which opens the outlet of the collapsible tube and simultaneously squeezes fluid out of the collapsible tube.

When cleaning the teeth with a toothbrush, people tends to squeeze the toothpaste with one end and holds the toothbrush with the other hand. However, it is difficult to accurate control the output amount of paste when squeezing the toothpaste by hand. If an excessive pressure is give to the toothpaste, an excessive amount of paste will be squeezed out of the toothpaste.

SUMMARY OF THE INVENTION

It is one object of the present invention to provide a collapsible tube squeezing apparatus which can be conveniently operated to automatically squeeze paste out of a collapsible tube for example a toothpaste or a tube of cream, etc. It is another object of the present invention to provide a collapsible tube squeezing apparatus which can be conveniently operated to squeeze a metered amount of paste out of a collapsible tube. According to the present invention, the apparatus comprises a base frame having two longitudinal tracks, and a longitudinal rack between the longitudinal tracks; a L-shaped supporting frame moved in the base frame along the longitudinal tracks, the L-shaped supporting frame including a vertical face plate and a horizontal bottom plate connected at right angles, the horizontal bottom plate having two opposite projections an projecting rods respectively moved in the longitudinal tracks and a pawl retained in engagement with the longitudinal rack of the base frame by a spring, the vertical face plate comprising a front side, a back side, a first through hole, a supporting hole, and at least one second through hole; an actuating plate pivotably connected to the back side of the vertical face plate, the actuating plate having a center opening, and a push rod inserted through the first through hole of the vertical face plate; a cover board pivotably connected to the front side of the vertical face plate and having a cover portion covered on the neck of the collapsible tube; and a push plate suspending below the cover board in front of the front side of the vertical face plate, having at least one connecting element inserted through the at least one second through hole of the vertical face plate and connected to the actuating plate; wherein the push rod of the actuating plate is forced to push the cover board away from the neck of the collapsible tube and the L-shaped supporting frame is simultaneously moved toward the rollers to squeeze the collapsible tube when the push plate is depressed, thereby causing fluid to be forced out of the collapsible tube.

DETAILED DESCRIPTION OF THE PREFERRED EMBODIMENT

Figure 1:
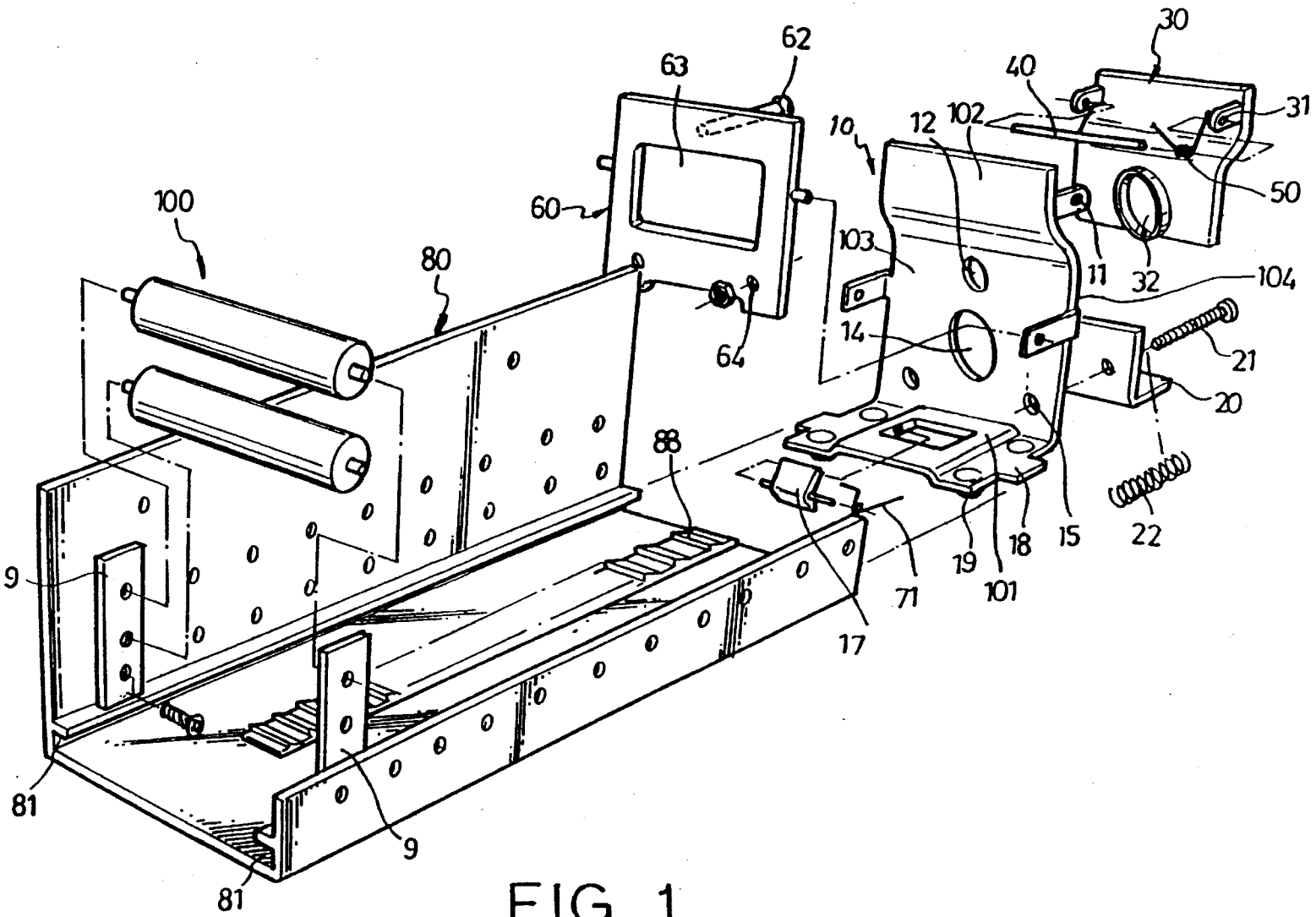
FIG. 1 is an exploded view of the apparatus of the preferred embodiment of the present invention.

Referring to FIG. 1, the apparatus of the preferred embodiment of the present invention is generally comprised of a substantially L-shaped supporting frame 10, a push plate 20, a cover board 30, an actuating plate 60, a base frame 80, and a pair of rollers 100. The rollers 100 are connected in parallel at different elevations between two upright connecting plates 9 inside the base frame 80. The L-shaped supporting frame 10 includes a bottom plate 101 and a face plate 102 connected at right angles. The bottom plate 101 comprises two projections an projections an projecting rods 18 horizontally disposed at two opposite sides respectively slidably inserted into two opposite longitudinal tracks 81 inside the base frame 80, a plurality of rolling balls or rotation wheels 19 at the bottom moved on the base frame 80, a pivoted pawl 17 retained into engagement with a longitudinal rack 88 inside the base frame 80 by a torsional spring 71 to prevent backward movement of the L-shaped supporting frame 10. The actuating plate 60 is pivotably connected to the back side 103 of the face plate 102, having a push rod 62 inserted through a through hole 12 on the face plate 102 of the L-shaped supporting frame 10. The cover board 30 is fastened to the front side 104 of the face plate 102, having a cover portion 32. The push plate 20 is connected to the lower part of the front side 104 of the face plate 102 by two screws 21. The screws 21 are respectively inserted through respective through holes 15 on the face plate 102 and then fastened to respective holes 64 on the actuating plate 60. Two springs 22 are respectively mounted around the screws 21 and stopped between the push plate 20 and the L-shaped supporting frame 10.

Figure 2:
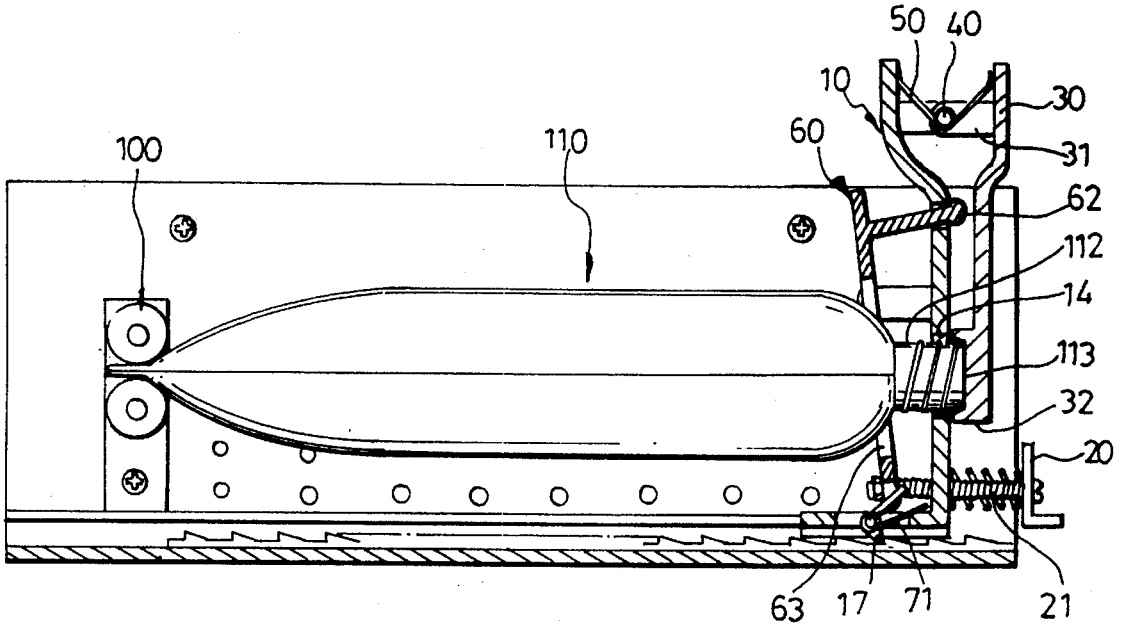
FIG. 2 is a sectional assembly view of the apparatus shown in FIG. 1, showing a collapsible tube installed therein.

Referring to FIG. 2 and FIG. 1 again, when a collapsible tube for example a toothpaste 110 is installed in the base frame 80, it is inserted through the center opening 63 of the actuating plate 60 with its flat tail of the toothpaste 110 jammed in between the rollers 100 and its neck 112 inserted into a hole 14 on the face plate 102. When installed, the outlet 113 of the toothpaste 110 is closed by the cover portion 32 of the cover board 30. Furthermore, there is a pivot pin 40 inserted through an eyed lug 11 at the front side 104 of the face plate 10, having two opposite ends respectively and pivotably connected two eyed lugs 31 of the cover board 30. A torsional spring 50 is mounted around the pivot pin 40, having two opposite ends respectively stopped against the cover board 30 and the face plate 102. The torsional spring 50 gives a pressure to the upper part of the cover board 30, causing the cover board 30 to force the cover portion 32 into engagement with the outlet 113 of the toothpaste 110.

Figure 3:
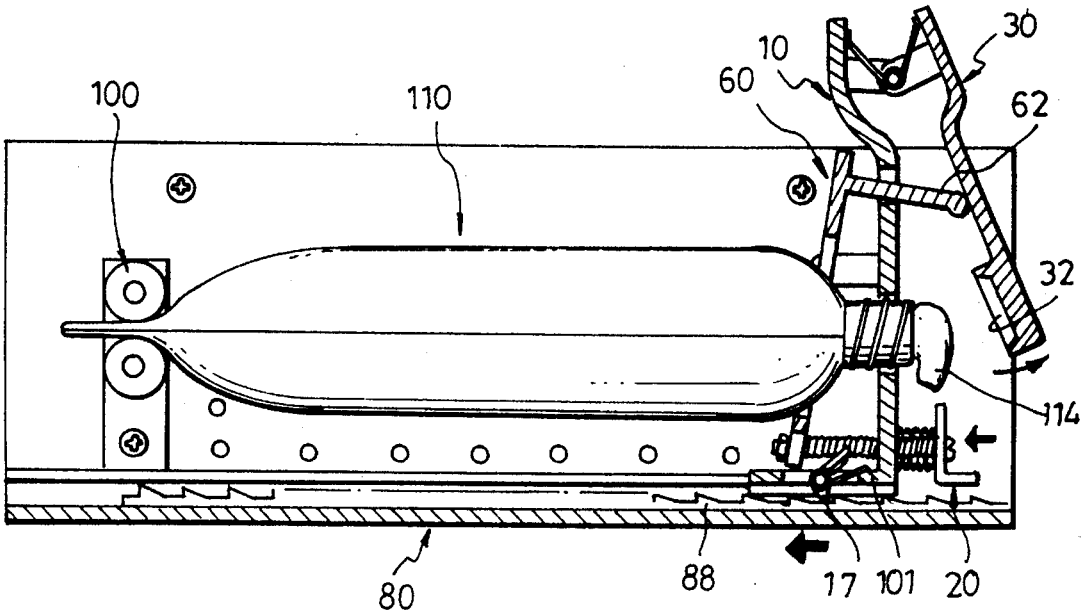
FIG. 3 is similar to FIG. 2 but showing a fluid squeezed out of the collapsible tube.

Referring to FIG. 3 and FIG. 2 again, when the push plate 20 is depressed, the push rod 62 of the actuating plate 60 is forced to move the cover board 30 outwards from the outlet 113 of the toothpaste 110, and at the same time the L-shaped supporting frame 10 is forced backwards to give a backward pressure to the toothpaste 110 against the rollers 100, and therefore paste 114 is forced out of the outlet 113 of the toothpaste 110. When the push plate 20 is released, the torsional spring 50 automatically forces the cover board 30 back to its former position, and therefore the cover portion 32 is closed on the outlet 113 of the toothpaste 110 again. Furthermore, because the pawl 17 is forced by the torsional spring 71 into engagement with the longitudinal rack 88, the L-shaped supporting frame 10 can only be moved toward the rollers 100, and the movement of the L-shaped supporting frame 10 can be accurately controlled step by step subject to the pitch of the teeth of the longitudinal rack 88.

While only one embodiment of the present invention has been shown and describe, it will be understood that various modifications and changes could be made without departing from the spirit and scope of the invention disclosed.

What the invention claimed is:

1. An apparatus for squeezing fluid out of the neck of a collapsible tube installed therein, the apparatus comprising:

a base frame having two longitudinal tracks, and a longitudinal rack between said longitudinal tracks;

a L-shaped supporting frame moved in said base frame along said longitudinal tracks, said L-shaped supporting frame including a vertical face plate and a horizontal bottoms plate connected at right angles, said horizontal bottom plate having two opposite projections respectively moved in said longitudinal tracks, said vertical face plate comprising a front side, a back side, a first through hole, a supporting hole, and at least one second through hole;

an actuating plate pivotably connected to the back side of said vertical face plate, said actuating plate having a center opening, and a push rod inserted through the first through hole of said vertical face plate;

a cover board pivotably connected to the front side of said vertical face plate and having a cover portion covering the neck of the collapsible tube; and a push plate suspending below said cover board in front of the front side of said vertical face plate, having at least one connecting element inserted through the at least one second through hole of said vertical face plate and connected to said actuating plate;

a plurality of rollers stationarily affixed at one end of the base frame opposite said L-shaped supporting frame for receiving a closed end of the collapsible tube for applying a squeezing force thereto;

wherein depressing the push plate moves the actuating plate causing the push rod of said actuating plate to push said cover board away from the neck of the collapsible tube and said L-shaped supporting frame along with said tube is simultaneously moved toward said rollers to squeeze the collapsible tube, thereby causing fluid to be forced out of the collapsible tube.

2. The apparatus of claim 1 wherein upright connecting plates are detachably fastened to two opposite sides of said base frame by fastening elements to support said rollers.

3. The apparatus of claim 1 wherein said L-shaped supporting frame has sliding means mounted at the horizontal bottom plate and supported on said base frame.

4. The apparatus of claim 3 wherein said sliding means comprises a plurality of rolling balls.

5. The apparatus of claim 3 wherein said sliding means comprises a plurality of rotating wheels.

6. The apparatus of claim 1 wherein said L-shaped supporting frame has a pawl forced by spring means into engagement with the longitudinal rack of said base frame.

7. The apparatus of claim 1 wherein said at least one second through hole of the vertical face plate of said L-shaped supporting frame comprises two second through holes; said at least one connecting element comprising two connecting rods, which are inserted through the second through holes of the vertical face plate of said L-shaped supporting frame.

8. The apparatus of claim 7 wherein said connecting rods are screw rods.

9. The apparatus of claim 7 wherein each of said two connecting rods is mounted with a respective spring, which is stopped between said push plate and the vertical face plate of said L-shaped supporting frame.

10. The apparatus of claim 7 wherein said cover board has two backward lugs, a pivot pin connected between said backward lugs, and a torsional spring mounted around said pivot pin and having two opposite ends respectively stopped at said cover board and the vertical face plate of said L-shaped supporting frame; the vertical face plate of said L-shaped supporting frame has a lug raised from the front side and turned about said pivot pin.

* * * * *